United States Patent [19]

Chao

[11] 4,292,090

[45] Sep. 29, 1981

[54] REMOVAL OF TITANIUM DIOXIDE FROM A FILTER ELEMENT

[75] Inventor: Chris C. Chao, Los Angeles, Calif.

[73] Assignee: Textron Inc., Providence, R.I.

[21] Appl. No.: 149,823

[22] Filed: May 15, 1980

[51] Int. Cl.[3] ..... B08B 3/08

[52] U.S. Cl. ..... 134/2; 134/29

[58] Field of Search ..... 134/2, 29, 30; 252/156; 210/791, 797

[56] References Cited

U.S. PATENT DOCUMENTS

| | | | |
|---|---|---|---|
| 2,861,015 | 11/1958 | Simon | 252/156 X |
| 3,553,015 | 1/1971 | Dohogne | 134/2 |
| 3,653,095 | 4/1972 | Dupre et al. | 134/2 X |
| 3,687,858 | 8/1972 | Geisler et al. | 252/156 |
| 3,690,949 | 9/1972 | Ng | 134/2 |

OTHER PUBLICATIONS

*Metals Handbook,* (8th Ed.), vol. 2, 1964, pp. 664–666.

*Primary Examiner*—Marc L. Caroff

*Attorney, Agent, or Firm*—Nilsson, Robbins, Dalgarn, Berliner, Carson & Wurst

[57] ABSTRACT

Titanium dioxide is removed from contaminated workpieces by immersing them in an alkaline solution containing calcium ions at approximately 30° C. The cleaning solution is made from a concentrated aqueous alkaline hydroxide solution and a calcium salt or from a basic calcium salt, e.g., calcium oxide.

11 Claims, No Drawings

REMOVAL OF TITANIUM DIOXIDE FROM A FILTER ELEMENT

FIELD OF INVENTION

This invention relates to the removal of titanium dioxide from contaminated workpieces. In particular, this invention relates to the use of calcium ion in aqueous alkaline solution to facilitate removal of titanium dioxide from contaminated workpieces.

BACKGROUND AND SUMMARY

Workpieces can become contaminated with titanium dioxide in several ways. Because titanium dioxide is a widely used white dye, many processes that involve dyeing objects or fabrics white will result in contaminated machinery, containers, and filters. Titanium dioxide scale frequently forms on titanium metal during working to produce objects made of the metal. In particular, filters used in the manufacturing process of polyester fabric that is dyed white become contaminated with titanium dioxide.

Titanium dioxide is used in the manufacture of polyester fiber primarily as a dye, and secondarily to prevent certain unwanted properties inherent in raw polyester fabric. During the manufacturing process, the liquid polyester is filtered, contaminating the filter media with organic compounds and titanium dioxide. The filter media is typically a fine stainless steel wire mesh nickel-brazed onto a base. During cleaning, the filter is subjected to a fluidized bath containing hot aluminum oxide particles to remove organic compounds. Titanium dioxide, aluminum oxide and residual organic compounds contaminate these filters after the initial cleaning, and are removed by the present invention.

The present invention utilizes calcium ion in conjunction with an alkaline solution which inhibits the formation of the insoluble, gelatinous sodium hydrogen (me) titanate ($NaHTiO_3$). The present invention provides an effective method for removal of titanium dioxide from contaminated workpieces under conditions that are exceedingly mild compared to conditions used in conventional techniques. Delicate workpieces can be cleaned using this method without damage.

The conventional methods for removing titanium dioxide and residual organic compounds require immersing the contaminated workpiece in hot, concentrated alkaline solution. Sodium hydroxide reacts with titanium dioxide to form sodium hydrogen titanate, a gelatinous substance that is virtually impossible to remove by mechanical techniques. It is the removal of this intractable substance that requires the rigorous conditions of conventional techniques. Examples of conventional techniques include those recited in U.S. Pat. Nos. 3,690,949 and 2,790,738. A method is disclosed in U.S. Pat. No. 3,690,949 involving immersing a contaminated workpiece in a hot (200° to 300° C.) solution of 50% sodium hydroxide, with small amounts of sodium nitrate, sodium nitrite, and sodium gluconate added. In U.S. Pat. No. 2,790,738 a method is disclosed that requires immersing the workpiece in molten alkali metal hydroxide, heated to approximately 700° F. Hot, concentrated alkali metal hydroxide will attack not only the stainless steel filtering media used in polymer fiber formation, but also the brazed connection of the filtering media to the base.

Recognizing the need for a more effective method to clean workpieces contaminated with titanium dioxide, and in particular a method that won't damage delicate workpieces due to conditions required to remove titanium dioxide, the present invention provides a method of removal of titanium dioxide utilizing mild conditions.

Titianium dioxide is removed from workpieces by immersing the workpieces in an alkali solution containing calcium ion. Calcium ion, in the form of a soluble calcium salt, is added to a 30% by weight aqueous sodium hydroxide solution. Typically, it is found that the calcium available for solution must be present in at least 2-fold molar excess compared to the titanium present in the titanium dioxide to be removed. The temperature of operation is optimally 30° C. Approximately 0.5 ml surfactant per liter of solution may be added. After 30 minutes of soaking, the workpiece is removed and rinsed, e.g., in water.

DETAILED DESCRIPTION

The initial step in removing titanium dioxide from contaminated workpieces is the formation of a suitable solution. A concentrated solution of sodium hydroxide is created by adding enough water to sodium hydroxide to make approximately a 30% by weight solution of sodium hydroxide.

When the water is added to the solid sodium hydroxide, there is typically a release of heat from the exotherionic reaction. Calcium ion may be added to this hot solution, or the solution may be cooled before the calcium ion is added.

A suitable source of calcium ion for the method according to this invention is calcium oxide. Calcium oxide, unlike many slats, is more soluble at lower temperatures than it is at higher temperatures. In the present invention, the optimum operating temperature is observed to be within 10° C. of 30° C. At this temperature, the optimum amount of calcium oxide is dissolved for efficient cleaning, although the present invention effectively removes titanium dioxide at a wide range of temperatures. Although calcium oxide is the preferred source of calcium ion in solution, other soluble calcium salts can be used, for example, calcium carbonate, calcium hydroxide, or calcium chloride.

When a workpiece contaminated with titanium dioxide is reacted with any strong alkaline solution, sodium hydrogen titanate is formed. Stainless stell filters, contaminated with pure titanium dioxide powder, can be cleaned by rinsing with water alone, but when the filters are placed in alkaline solution to remove organic residue, sodium hydrogen titanate formation occurs, making removal of the cntaminates extremely difficult. The alkaline solution is necessary in the case of the polymer filters, because even after cleaning with a fluidized bath, there adheres to the filter media some residual organic material that acts as an adhesive for titanium dioxide particles. Strong alkaline solution removes any residual organic material. The calcium ion prevents formation of the sodium hydrogen (me)titanate allowing easy removal of the titanium dioxide particles.

The calcium ion in the present invention is usually in excess of the amount of titanium dioxide to be removed. In practice, the amount of titanium dioxide is small, so that any large amount of calcium salt added will typically be a sufficient excess. A practical limit observed is calcium ion available for solution must exceed the amount of titanium dioxide in the cntaminated workpiece by a factor of two.

For proper action of the solution, the sodium hydroxide concentration must exceed the calcium ion concentration. In practice, unless very dilute sodium hydroxide solution is used, this condition will naturally be met, because of the limited solubility of calcium containing salts, particularly calcium oxide.

An alkaline solution containing only added calcium ion efficiently removes titanium dioxide, but it has been found that a small amount of surfactant, added to such a solution, results in an even more effective titanium dioxide removal solution. The surfactant need be present in small concentrations, for example, 1 gram/liter to be effective. A household detergent performs excellently as a surfactant.

The contaminated workpiece is immersed in the solution for 10–30 minutes. The titanium dioxide will be observed to slowly loosen from the workpiece. Any titanium dioxide that adheres to the workpiece is easily rinsed off in water. In the case of polymer filters, titanium dioxide, residual organic material and some residual aluminum oxide from the fluidized bath are removed by this process.

The present invention provides a method with mild conditions that will effectively remove titanium dioxide. Delicate workpieces, for example, the filter media and the brazed connection, are undamaged by this method.

The following examples further illustrate the invention:

EXAMPLE 1

400 grams of commercial grade sodium hydroxide was mixed with enough water to make 800 ml solution. Approximately 20 grams of commercial grade calcium oxide was then added to the hot alkaline solution. As the solution cooled, the white calcium oxide powder was observed to dissolve in the solution. An amount of 0.5 ml of commercial household detergent was then added. A piece of stainless steel filtering media previously contaminated with titanium dioxide powder was immersed in the solution when it reached a temperature of 30° C. After 20 minutes, the filter media was removed and rinsed with water. The media was then free of any visible traces of titanium dioxide.

Control A

Example 1 was repeated, except that no calcium ion source of any kind was added to the solution. After 30 minutes, no significant removal of titanium dioxide had occurred. The filter was covered with a viscous white gel that could not be rinsed off in flowing water.

EXAMPLES 2–4

If Example 1 is repeated using as a calcium source calcium hydroxide, calcium carbonate, or calcium chloride, the contaminated workpiece will be as efficiently cleaned as it was in Example 1.

EXAMPLE 5

If Example 1 is repeated, except no surfactant is added, the titanium dioxide will be efficiently removed as before, although slightly more rinsing may be needed.

EXAMPLE 6

Example 1 was substantially repeated in a series of runs designed to demonstrate the effectiveness of titanium dioxide removal in increasing concentrations of sodium hydroxide. In each instance, the maximum temperature is substantially the boiling temperature of the solution; boiling solution was not used since it was desired to keep the hot, concentrated sodium hydroxide solution from bubbling and noncorrosive to filter media. In each instance, the source of calcium ion was commercial grade calcium oxide and the time of immersion was 20 minutes. In every instance, titanium dioxide was removed.

TABLE 1

| NaOH Concentration (grams/liter of solution) | Temperature Range Observed To be Effective (°C.) |
|---|---|
| 55.06 | 10°–98.8° |
| 149.97 | 10°–103.3° |
| 262.86 | 10°–104.4° |
| 357.52 | 10°–107.2° |
| 438.99 | 10°–115.5° |
| 557.81 | 10°–121.1° |

What is claimed is:

1. A method for removing titanium dioxide from contaminated workpieces, comprising:

immersing the workpiece in an aqueous alkaline solution, the solution containing sufficient calcium ions to convert the titanium dioxide to a rinsable product; and rinsing the workpiece.

2. The method of claim 1 wherein the molar concentration of calcium ions exceeds the concentration of titanium dioxide to be removed from the workpiece.

3. The method of claim 2 wherein the molar concentration of calcium ions exceeds the amount of titanium dioxide to be removed by a factor of at least 2.

4. The method of claim 1 wherein the alkaline solution comprises dissolved sodium hydroxide at a concentration of at least 55 grams sodium hydroxide per liter of solution.

5. The method of claim 1 wherein the calcium ion is derived from a salt selected from the group consisting of calcium oxide, calcium hydroxide, calcium carbonate, and calcium chloride.

6. The method of claim 1 wherein the solution contains at least 0.5 ml surfactant per liter of solution.

7. The method as described in claim 1 wherein the temperature of the solution is maintained to within 10° C. of 30° C.

8. A method for removing titanium dioxide from contaminated workpieces, comprising:

immersing the workpiece in an aqueous sodium hydroxide solution of at least 55 grams of sodium hydroxide per liter of solution, the solution containing enough calcium oxide so that the molar concentration of calcium ions exceeds the amount of titanium dioxide to be removed by at least a factor of 2, while the temperature of the solution is maintained at substantially 30° C.

9. The method of claim 8 wherein the temperature of the solution is maintained within 10° C. of 30° C.

10. The method of claim 8 wherein the concentration of sodium hydroxide is within the range from 55 grams per liter to 557 grams per liter.

11. The method of claim 10 wherein the temperature is in a range from 10° C. to almost substantially the boiling point of the solution.

* * * * *